US012072170B2

(12) United States Patent
Björkgren

(10) Patent No.: US 12,072,170 B2
(45) Date of Patent: Aug. 27, 2024

(54) SHAPED CHARGE ASSEMBLY

(71) Applicant: SAAB AB, Linköping (SE)

(72) Inventor: Victor Björkgren, Karlskoga (SE)

(73) Assignee: SAAB AB, Linköping (SE)

( * ) Notice: Subject to any disclaimer, the term of this patent is extended or adjusted under 35 U.S.C. 154(b) by 91 days.

(21) Appl. No.: 17/793,685

(22) PCT Filed: Jan. 21, 2020

(86) PCT No.: PCT/SE2020/050051
§ 371 (c)(1),
(2) Date: Jul. 19, 2022

(87) PCT Pub. No.: WO2021/150151
PCT Pub. Date: Jul. 29, 2021

(65) Prior Publication Data
US 2023/0052273 A1 Feb. 16, 2023

(51) Int. Cl.
*F42B 1/028* (2006.01)
*F42B 1/032* (2006.01)

(52) U.S. Cl.
CPC ..... *F42B 1/028* (2013.01); *F42B 1/032* (2013.01)

(58) Field of Classification Search
CPC ..... F42B 1/028; F42B 1/032; F42B 12/18
USPC ..... 102/476
See application file for complete search history.

(56) References Cited

U.S. PATENT DOCUMENTS

| | | | | |
|---|---|---|---|---|
| 2,984,307 | A | 5/1961 | Barnes | |
| 4,436,033 | A * | 3/1984 | Precoul | F42B 1/028 102/307 |
| 4,672,896 | A * | 6/1987 | Precoul | F42B 1/028 102/476 |
| 4,798,145 | A | 1/1989 | McVeagh | |
| 5,394,804 | A | 3/1995 | Cauchetier | |
| 7,954,433 | B1 | 6/2011 | Barnett | |
| 8,375,859 | B2 * | 2/2013 | Sagebiel | F42B 1/028 102/306 |
| 2004/0200377 | A1 * | 10/2004 | Collins | F42B 1/028 102/476 |

FOREIGN PATENT DOCUMENTS

| | | |
|---|---|---|
| FR | 1161445 A | 8/1958 |
| FR | 1177197 A1 | 4/1959 |

(Continued)

OTHER PUBLICATIONS

International Preliminary Report on Patentability mailed Dec. 14, 2021 for International Application No. PCT/SE2020/050051, 11 pages.

(Continued)

*Primary Examiner* — Bret Hayes
(74) *Attorney, Agent, or Firm* — Sage Patent Group

(57) ABSTRACT

A shaped charge assembly, comprising a casing and a liner, is disclosed. The liner includes a first longitudinal section connected to the casing, a second longitudinal section having the shape of a truncated cone wherein the truncated end thereof is directly connected, or connected by means of an intermediate longitudinal section, to the first longitudinal section. The second longitudinal section is at its base end directly connected to a third longitudinal section. The third longitudinal section is in the shape of a cone, an ogival or a hemisphere.

11 Claims, 3 Drawing Sheets

(56) References Cited

FOREIGN PATENT DOCUMENTS

| | | | | |
|---|---|---|---|---|
| FR | 2496252 | A1 * | 6/1982 | ..... F42B 12/18 |
| KR | 100930374 | B1 | 12/2009 | |

OTHER PUBLICATIONS

Extended European Search Report mailed Aug. 24, 2023 for European Patent Application No. 20916110.8, 8 pages.
Brazilian Written Opinion for Brazilian Patent Application No. 112022012811-8, dated Nov. 10, 2023, 6 pages (including English summary of Office Action).

* cited by examiner

SHAPED CHARGE ASSEMBLY

CROSS-REFERENCE TO RELATED APPLICATIONS

This application is a 35 U.S.C. § 371 national stage application for International Application No. PCT/SE2020/050051, entitled "SHAPED CHARGE ASSEMBLY", filed on Jan. 21, 2020, the disclosures and contents of which are hereby incorporated by reference in their entireties.

TECHNICAL FIELD

The present disclosure relates in general to a shaped charge assembly.

BACKGROUND

A shaped charge is an explosive charge that is shaped to focus the effect of the explosive's energy. Such a shaped charge generally comprises a casing and a liner together defining a volume therebetween comprising the explosive. The liner may typically have the form of a hemisphere or a cone, or be trumpet-shaped. When the explosive is detonated, the liner collapses and is squeezed forward, and thereby forms a jet. The jet tip may travel faster than 10 kilometres per second whereas the jet tail has a considerably lower velocity. The jet properties, and thus the penetration capability of the shaped charge, depend inter alia on the shape of the liner, the energy released, as well as the mass and composition of the liner.

Although conventionally known shaped charge liners having e.g. a conical shape generally has sufficient penetration capability, it is desired to provide a liner forming a jet on detonation which may provide even deeper penetration.

SUMMARY

The object of the present invention is a shaped charge assembly that can provide improved penetration capability of a formed jet into for example armour, such as homogenous armour.

The object is achieved by the subject-matter of the appended independent claim.

In accordance with the present disclosure, a shaped charge assembly is provided. The shaped charge assembly comprises a casing and a rotational symmetrical liner. The casing and the liner are coaxially arranged around a longitudinal central axis. The casing and the liner together defines a volume configured to contain an explosive. The liner comprises a first longitudinal section having the shape of a truncated cone, being tulip-shaped, being trumpet-shaped, or being partial-hemisphere shaped, and comprising a base end and an opposing truncated end, the first longitudinal section being connected at its base end to the casing. The liner further comprises a second longitudinal section having the shape of a truncated cone and comprising a base end and an opposing truncated end, the truncated end of the second longitudinal section being directly connected, or connected by means of an intermediate longitudinal section, to the truncated end of the first longitudinal section. The liner further comprises a third longitudinal section being directly connected to the base end of the second longitudinal section, the third longitudinal section having the shape of a cone, an ogival or a hemisphere. A tangent of a radially internal surface of the third longitudinal section and a tangent of a radially internal surface of the second longitudinal section at the connection between the third longitudinal section and the second longitudinal section forms an angle β of from 80° to 130°. If present, the intermediate longitudinal section consists of a first longitudinal portion and a second longitudinal portion, the first longitudinal portion being directly connected to the first longitudinal section and the second longitudinal portion being directly connected to the second longitudinal section, and wherein the first longitudinal portion is in the shape of a truncated cone having cone angle smaller than a cone angle of the second longitudinal section.

By means of the shaped charge assembly according to the present disclosure, greater penetration depths may be achieved as a result of the specific configuration of the liner. More specifically, higher velocity of the penetration jet is achieved as a result of the specific configuration of the liner, which in turn increases the penetration depth.

The third longitudinal section may for example have a longitudinal extension of maximally 20% of the longitudinal extension of the liner. The first longitudinal section may for example have a longitudinal extension of at least 50% of the longitudinal extension of the liner. The first longitudinal section may have a longitudinal extension of at most 80% of the longitudinal extension of the liner. The inner diameter of the second longitudinal section at its truncated end may be within the range of 20% to 40%, preferably 20-35%, of the inner diameter at the base end of the first longitudinal section. The third longitudinal section may have the shape of an ogival or a hemisphere having a radius ranging from 5% to 85%, preferably 20% to 60%, of the diameter of the first longitudinal section at the base end of the first longitudinal section.

The liner may have a wall thickness of from 0.1 to 5 mm. Thereby, the intended collapse of the liner is facilitated, which in turn improves the jet properties.

The liner may for example be made of a metallic material having a density of from 2 g/cm$^3$ to 25 g/cm$^3$. Thereby, the liner can be easily produced in accordance with conventional methods for producing liners, and still provide a greater penetration depth compared to conventional liners.

When an intermediate section comprising a first and second longitudinal portion is present, a tangent of a radially internal surface said first longitudinal portion and a tangent of a radially internal surface of said second longitudinal portion may form an angle γ which is smaller than the angle β, wherein the tangent of the radially internal surface of said second longitudinal portion is midway of a radial extension of the second longitudinal portion.

DETAILED DESCRIPTION

Figure 1A:
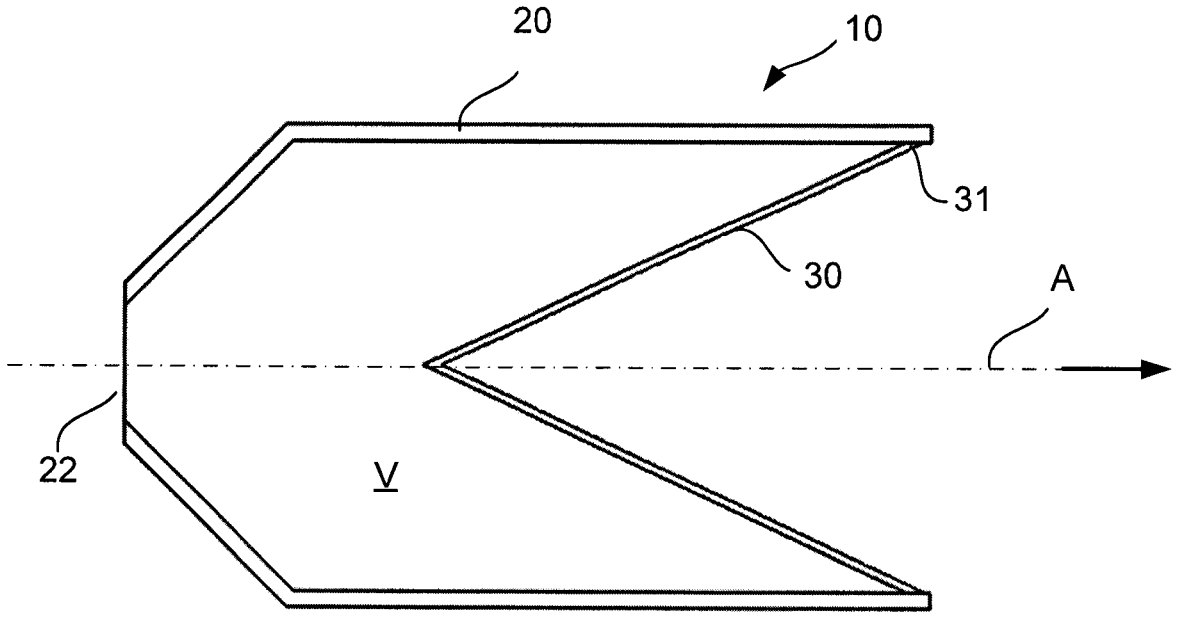
FIG. 1*a* illustrates a cross sectional view of a shaped charge assembly comprising a conventional liner having a conical shape.

The invention will be described in more detail below with reference to exemplifying embodiments and the accompanying drawings. The invention is however not limited to the exemplifying embodiments discussed and/or shown in the drawings, but may be varied within the scope of each of the appended independent claims. Furthermore, the drawings shall not be considered to necessarily be drawn to scale as some features may be exaggerated in order to more clearly illustrate the invention or features thereof.

FIG. 1*a* illustrates a cross sectional view of a shaped charge assembly 10 comprising a casing 20 and a conventional liner 30 having a conical shape. The casing 20 and liner 30 are rotational symmetrical and coaxially arranged around a central axis A of the shaped charge assembly. The liner 30 is at its base end 31 connected to the casing 20. The casing 20 and the liner 30 together defines a volume V configured to contain an explosive to be detonated. The casing 20 comprises an opening 22 in which a detonation device may be arranged for detonating the explosive. An explosive arranged in the volume V would thus be enclosed by the casing, the liner and the detonation device. When the explosive is detonated, the liner will collapse as a result of the shock wave caused by the detonation front, and form a jet which will travel in the direction of the arrow shown in the figure. A resulting penetration depth in a target is dependent of the jet properties.

More specifically, the collapse of the liner as shown in FIG. 1*a* will start at the tip of the liner since this is the first part of the liner reached by the shock wave. As the collapse continues, the material of the liner will join along the central axis of the shaped charge assembly in the discharge direction and thus form the resulting jet. The tip of the resulting jet will have a much higher speed than the end of the jet, and therefore, the jet will after a short period of time be divided into a penetrating part having a very high velocity and a slug having a lower velocity.

Figure 1B:
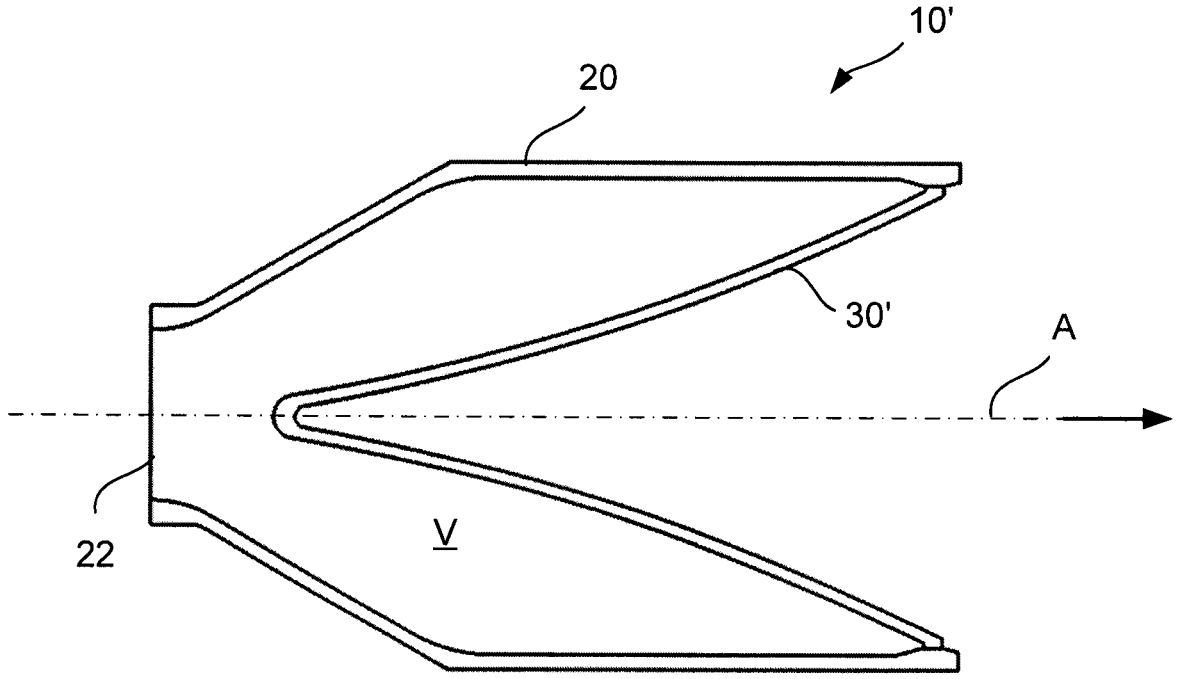
FIG. 1*b* illustrates a cross sectional view of a shaped charge assembly comprising a conventional liner having a trumpet-shaped liner.

FIG. 1*b* illustrates a cross sectional view of another example of a shaped charge assembly 10'. The shaped charge assembly 10' is similar to the shaped charge assembly as shown in FIG. 1*a*, and comprises a rotational symmetrical casing 20 and a rotational symmetrical liner 30'. However, the liner 30' has a trumpet shape in contrast to the conical shape of the liner 30.

The shaped charge assembly according to the present disclosure comprises a liner having a different shape than the liners 30 and 30' as shown in FIGS. 1*a* and 1*b*, respectively. More specifically, the shaped charge assembly according to the present disclosure comprises a liner comprising a plurality of longitudinal sections, which will be described in more detail below. The longitudinal sections causes the liner to temporarily form a plurality of jet portions during the collapse, the jet portions being combined to the resulting jet being discharged.

In accordance with the present disclosure, a shaped charge assembly comprising a casing and a rotational symmetrical liner is provided. The casing and the liner are coaxially arranged around a longitudinal central axis, and together defines a volume configured to contain an explosive. The casing and the liner together defines a volume configured to contain an explosive. The liner comprises a first longitudinal section having the shape of a truncated cone, being tulip-shaped, being trumpet-shaped, or being partial-hemisphere shaped. The first longitudinal section comprises a base end, at which the diameter of the first longitudinal section is the greatest, and an opposing truncated end, at which the diameter of the first longitudinal section is the smallest. The first longitudinal section is connected at its base end to the casing. The connection between the first longitudinal section and the casing may be performed by any previously known means for connecting a liner to a casing of a shaped charge, and will therefore not be further discussed in the present disclosure.

The liner further comprises a second longitudinal section having the shape of a truncated cone and comprising a base end, at which the diameter of the second longitudinal end is the greatest, and an opposing truncated end, at which the diameter of the second longitudinal end is the smallest. The truncated end of the second longitudinal section is directly connected, or connected by means of an intermediate longitudinal section, to the truncated end of the first longitudinal section.

The liner further comprises a third longitudinal section being directly connected to the base end of the second longitudinal section. The third longitudinal section has the shape of a cone, an ogival or a hemisphere. A tangent of a radially internal surface of the third longitudinal section and a tangent of a radially internal surface of the second longitudinal section at the connection between the third longitudinal section and the second longitudinal section forms an angle β of from 80° to 130°, preferably from 100° to 125°.

If present, the intermediate longitudinal section consists of a first longitudinal portion and a second longitudinal portion. The first longitudinal portion is in such a case directly connected to the first longitudinal section and the second longitudinal portion is directly connected to the second longitudinal section. The first longitudinal portion and the second longitudinal portion are directly connected to each other. Furthermore, the first longitudinal portion of the intermediate section is in the shape of a truncated cone having cone angle smaller than a cone angle of the second longitudinal section.

The third longitudinal section should suitably have a relatively short longitudinal extension in comparison to the longitudinal extension of the liner. The third longitudinal section may for example have a longitudinal extension of maximally 20% of the longitudinal extension of the liner. Thereby, the jet portions which are formed during the collapse will meet along the central axis and the jet portion which is formed by the material from the connection of the third longitudinal section and the second longitudinal section may be swept with the material of the jet portion resulting from the first material of the liner which forms the jet.

The first longitudinal section may have a longitudinal extension of at least 50% of the longitudinal extension of the liner and may for example be up to 80% of the longitudinal extension of the liner.

The inner diameter of the second longitudinal extension at its truncated end may be within 20% to 40% (including the end values), preferably 20% to 35%, of the inner diameter at the base end of the first longitudinal section.

In case the third longitudinal section has the shape of an ogival or a hemisphere, the radius of the ogival or hemisphere may suitably be from 5% to 85%, preferably 20% to 60%, of the diameter of the diameter of the first longitudinal section at its base end.

The liner should have a wall thickness that allows the liner to easily collapse and form the jet as desired. For example, the liner may have a wall thickness of 0.1-5 mm. Preferably, the wall thickness of the liner is 1-5 mm, more preferably 1-3 mm, most preferably 1.5-2.5 mm.

The liner suitably has a density from 2 g/cm$^3$ to 25 g/cm$^3$, preferably from 2 to 20 g/cm$^3$. By the term "density" is meant hereby meant the average density in case the liner is composed of a mixture of materials.

The liner may for example be made of a metallic material, such as copper, tungsten, or alloys based on copper or tungsten. However, other materials may also be used to form the liner if desired. Examples of other materials from which the liner may be formed include polymeric material, ceramics or mixtures thereof, as well as a mixture of polymeric and metallic material.

The liner may further comprise a coating, if desired. According to one exemplifying embodiment, a layer of an aluminium powder is adhered to the surface of the liner configured to face the explosive. The particle size of such a power may for example range from 50-500 μm, preferably 100-300 μm. When an intermediate section comprising a first longitudinal portion and second longitudinal portion is present, the tangent of a radially internal surface said first longitudinal portion and a tangent of a radially internal surface of said second longitudinal portion forms an angle γ. Here, the tangent of the radially internal surface of said second longitudinal portion is midway of a radial extension of the second longitudinal portion. The angle γ may be smaller than the angle β.

Figure 2:
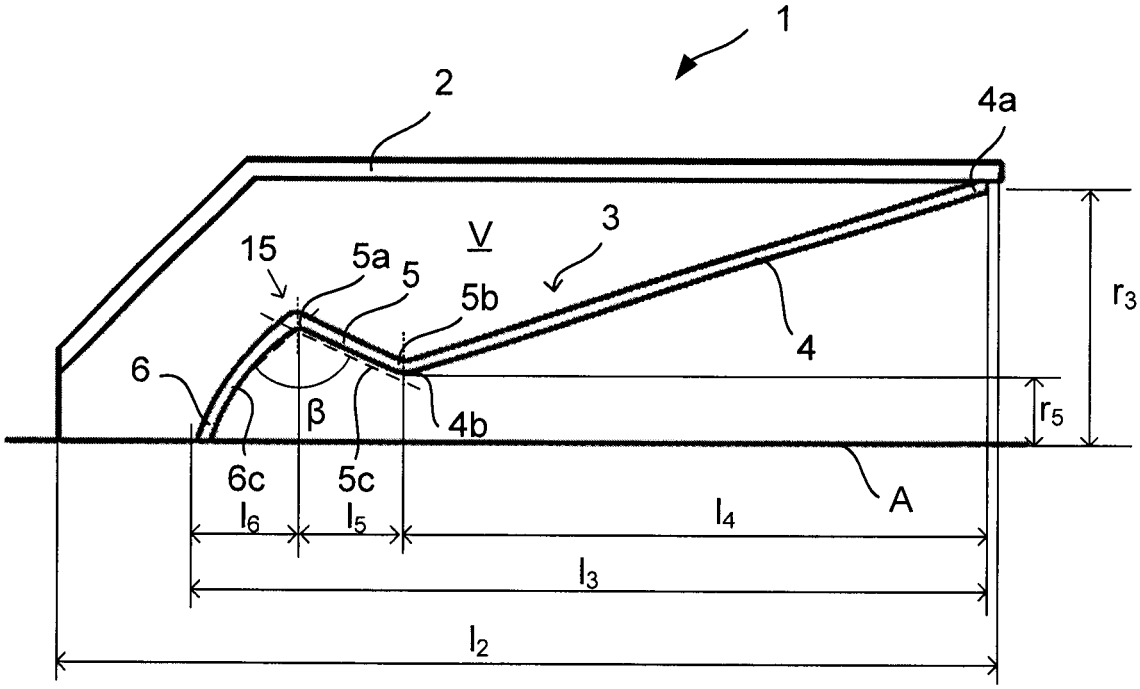
FIG. 2 illustrates a half cross-sectional view of a shaped charge assembly comprising a liner in accordance with a first exemplifying embodiment of the present disclosure.

FIG. 2 illustrates a half cross-sectional view of a shaped charge assembly 1 in accordance with a first exemplifying embodiment of the present disclosure. The shaped charge assembly 1 comprises a rotational symmetrical casing 2 and a rotational symmetrical liner 3. The casing 2 and the liner are coaxially arranged around a central axis A of the shaped charge assembly 1, and together defines a volume V intended for an explosive. The liner 3 consists of a first longitudinal section 4, a second longitudinal section 5 and a third longitudinal section 6. The first longitudinal section 4 has the shape of a truncated cone, and thus comprises a base end 4*a* and an opposing truncated end 4*b*. The first longitudinal section 4 is connected at its base end to the casing 2. The second longitudinal section 5 also has the shape of a truncated cone, and thus comprises a base end 5*a* and a truncated end 5*b*. The truncated end 5*b* of the second longitudinal section 5 faces the truncated end 4*b* of the first longitudinal section 4 and is connected thereto. More specifically, the truncated end 5*b* of the second longitudinal section 5 is directly connected to the truncated end 4*b* of the first longitudinal section without any intermediate section. The liner further comprises a third longitudinal section 6 which is directly connected to the based end 5*a* of the second longitudinal section 5. The third longitudinal section 6 shown in FIG. 2 has the shape of an ogival. However, the third longitudinal section 6 may alternatively have the shape of a cone or a hemisphere, if desired. The third longitudinal section 6 is arranged close to an initiation end of the shaped charge assembly whereas the first longitudinal section 4 is arranged at a discharge end of the shaped charge assembly.

As shown in FIG. 2, a tangent of a radially internal surface 6*c* of the third longitudinal section 6 and a tangent of a radially internal surface 5*c* of the second longitudinal section, at the connection between the third and second longitudinal sections, forms an angle β. The angle β may range from 80° to 130°. Furthermore, the connection between the second longitudinal section 5 and the third longitudinal section 6 may be described as forming a circumferential tip 15 of the liner.

As shown in FIG. 2, the longitudinal extension $I_3$ of the liner 3 is smaller than the longitudinal extension $I_2$ of the casing. Furthermore, the longitudinal extension $I_4$ of the first longitudinal section 4 may typically have a greater longitudinal extension than the longitudinal extension $I_5$ of the second longitudinal section 5 as well as the longitudinal extension $I_6$ of the third longitudinal section 6. The longitudinal extension $I_4$ of the first longitudinal section 4 may suitably be at least 50% of the longitudinal extension $I_3$ of the liner 3, and/or at most 80% of the longitudinal extension $I_3$ of the liner 3. The third longitudinal section 6 may for example have a longitudinal extension $I_6$ that is at most 20% of the longitudinal extension $I_3$ of the liner 3.

The first longitudinal section 4 has a radius at its base end 4*a* which is the same at the radius $r_3$ of the liner as such at the end where it is connected to the casing 2. FIG. 2 also illustrates the inner radius $r_5$ of the second longitudinal section 5 at its truncated end 5*b*. $r_5$ of the second longitudinal section 5 at its truncated end 5*b* may for example be within the range of 20% to 40% of the inner radius $r_3$ at the base end of the first longitudinal section.

Figure 2A:
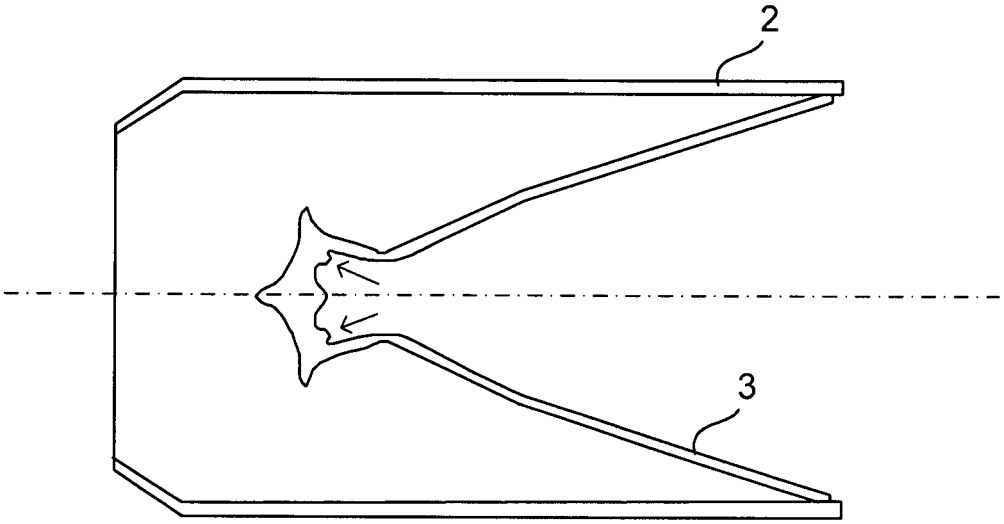
FIG. 2*a* illustrates the shaped charge assembly shown in FIG. 2 at a point in time shortly after detonation and at which the liner has started to collapse.

FIG. 2*a* schematically illustrates the shaped charge assembly as shown in FIG. 2 shortly after the explosive has been detonated and the liner 3 has started to collapse, but before a jet has been formed. As can be seen from the figure, the material of the tip of the third longitudinal section 6 has formed a first jet portion along the central axis A of the shaped charge in the direction of discharge. Moreover, the material of the circumferential tip 15 (shown in FIG. 2) forms a second jet portion, illustrated by the arrows in FIG. 2*a*, which has a direction that is inclined with regards to the central axis and in the discharge direction. The second jet portion is "swept" with the first jet portion. The collision of the material of the collapsed liner along the central axis will therefore be softer compared to a direct collision at the central axis as would occur in a conventional conical liner as shown in FIG. 1*b*. Therefore, the collision velocity relative to the collision point is reduced in comparison with a conical liner, and the resulting jet may be designed to have a considerably higher speed compared to a conical liner. This in turn increases the penetration depth in a target.

Figure 3:
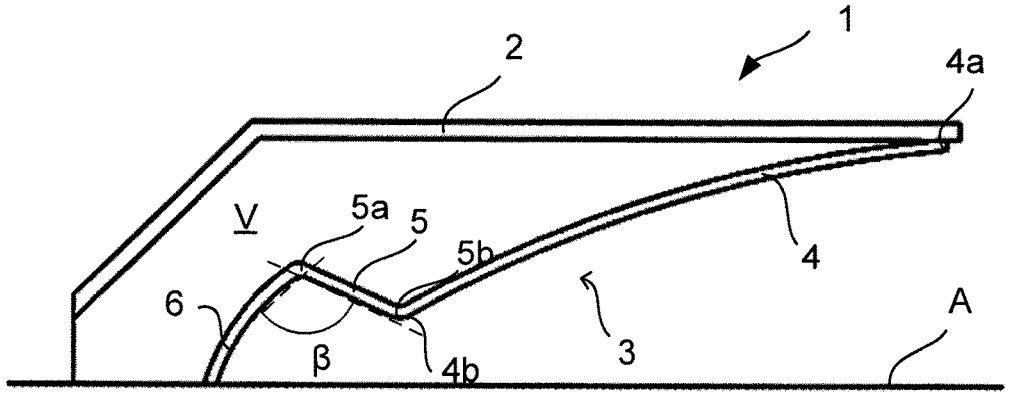
FIG. 3 illustrates a half cross-sectional view of a shaped charge assembly comprising a liner in accordance with a second exemplifying embodiment of the present disclosure.

FIG. 3 illustrates a half cross-sectional view of a shaped charge assembly 1 in accordance with a second exemplifying embodiment of the present disclosure. The shaped charge assembly according to the second exemplifying embodiment is similar to the shaped charge assembly according to the first exemplifying embodiment illustrated in FIG. 2, but the first longitudinal section 4 of the liner 3 has a different shape. The first longitudinal section 4 of the liner 3 as shown in FIG. 3 is tulip-shaped.

Figure 4:
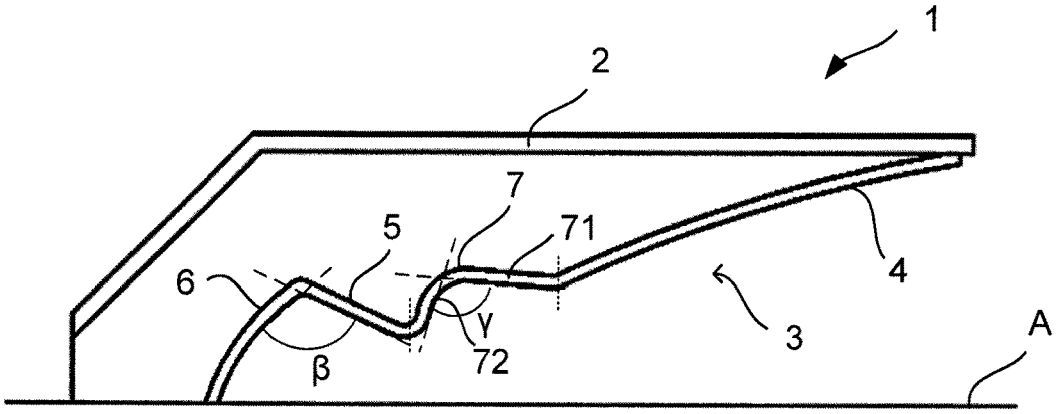
FIG. 4 illustrates a half cross-sectional view of a shaped charge assembly comprising a liner in accordance with a third exemplifying embodiment of the present disclosure.

FIG. 4 illustrates a half cross-sectional view of a shaped charge assembly 1 in accordance with a third exemplifying embodiment of the present disclosure. In contrast to the shaped charge assemblies shown in FIGS. 2 and 3, the shaped charge assembly shown in FIG. 4 comprises a liner wherein the first longitudinal section 4 is not directly connected to the second longitudinal section 5.

Instead, an intermediate longitudinal section 7 is present between the first longitudinal section 4 and the second longitudinal section 5. More specifically, the truncated end 5*b* of the second longitudinal section 5 is connected be means of the intermediate longitudinal section 7 to the truncated end 4*b* of the first longitudinal section 4. The intermediate longitudinal section 7 consists of a first longitudinal portion 71 and a second longitudinal portion 72. The first longitudinal portion 71 is directly connected to the first longitudinal section 4. Furthermore, the second longitudinal portion 72 is directly connected to the second longitudinal section 5. The first longitudinal portion 71 has the shape of a truncated cone, and has a cone angle that is smaller than the cone angle of the second longitudinal section 5. In other words, the inclination of the first longitudinal portion 71 in relation to the central axis A is smaller than the inclination of the second longitudinal section 5 in relation to the central axis A.

As shown in FIG. 4, the first and second longitudinal portions 71, 71 may be connected to each other with a radius. It is however also plausible that the first and second longitudinal portions of the intermediate longitudinal section are connected to each other so as their inner surfaces forming an acute angle at the connection point.

The second longitudinal portion 72 may be described has having a radial extension, which in this disclosure is considered to mean the distance between a first plane, parallel to the central axis A, at which the second longitudinal portion 72 connects to the second longitudinal section 5, and a second plane, parallel to the central axis A, at which the second longitudinal portion 72 connects to the first longitudinal portion 71. As shown in FIG. 4, a tangent of a radially internal surface the first longitudinal portion 71 of the intermediate section 7 and a tangent of a radially internal surface of the second longitudinal portion 72, midway of the radial extension of the second longitudinal portion 72, forms an angle $\gamma$ as shown in the figure. The angle $\gamma$ may be smaller than the angle $\theta$.

Figure 5:
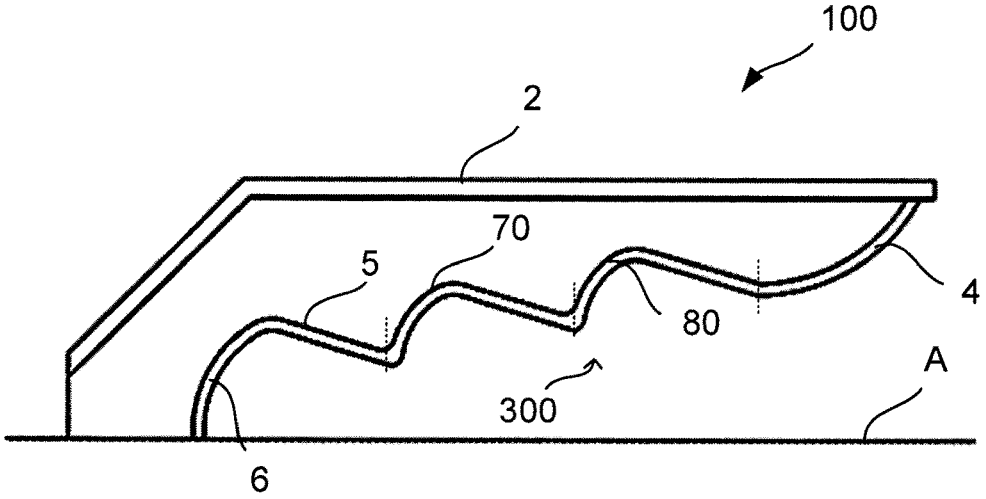
FIG. 5 illustrates a half cross-sectional view of a shaped charge assembly comprising a comparative liner.

FIG. 5 illustrates a half cross-sectional view of a shaped charge assembly 100 according to a comparative example, not being part of the shaped charge assembly according to the present disclosure. The shaped charge assembly 100 comprises a casing 2 and a liner 300. The liner 300 comprises a first longitudinal section 4, a second longitudinal section 5 and a third longitudinal section 6 just like the liners 3 shown in FIGS. 2 to 4. However, in contrast to the liners 3 shown in FIGS. 2 and 3, in the liner 300 the second longitudinal section 5 is not directly connected to the first longitudinal section 4. Furthermore, the liner 300 differs from the liner 3 shown in FIG. 4 in that the second longitudinal section is connected by means of a first intermediate section 70 (similar to intermediate section 7 shown in FIG. 4), as well as a second intermediate section 80, to the first longitudinal section 4. In other words, the intermediate longitudinal section 70 does not consist of a first longitudinal portion and a second longitudinal portion, wherein the first longitudinal portion is directly connected to the first longitudinal section 4 and the second longitudinal portion is directly connected to the second longitudinal section 5. Nor does the second intermediate longitudinal section consist of first longitudinal portion and a second longitudinal portion, wherein the first longitudinal portion is directly connected to the first longitudinal section 4 and the second longitudinal portion is directly connected to the second longitudinal section 5.

Methodology

Various shapes of a liner have been investigated by means of simulation tests. More than 500 models have been tested in more than 700 simulations performed in Ansys Workbench 17.2 and 19.0. The models were drafted in SpaceClaim, meshed in Explicit Dynamics and solved in Autodyn by means of 2D rotations symmetry. Jet data with respect to velocity profile, jet length and jet mass were calculated for all models. The simulations were arranged by filling an Euler body with explosive and liner according to the various models. The Euler body was positioned 5 mm behind the warhead and extended such that its outer end was 100 mm in front of the point where the liner was attached to the casing. The height of the Euler body was 50 mm and the element size was 3 elements per millimetre. In the event a wave shaper was provided in the model, the Euler body only extends up to the end of the wave shaper. Free outflow of material was defined along all edges. A gauge point was defined along the centre line and the rear end of the Euler body, i.e. the point where the jet leaved the Euler body. 50 μs after initiation of the explosive, all explosive material was erased since some of the models otherwise would suffer from a short time step. The velocity at the gauge point and the total mass of copper leaving the Euler body was saved subsequent to the simulation.

A penetration model was set up in the same was as the model for jet data. The difference was in the case of the penetration model that the Euler body continued 205 mm, 300 mm, or 400 mm depending on which stand-off was simulated. Thereafter, the Euler body continued a further 700 mm (900 mm if the stand-off was 400 mm). These 700 mm were filled with Rolled Homogenous Armour (RHA) and lacked outflows along the edges. The simulation was terminated when the tip of the jet has stopped. In some cases, the RHA part was elongated if the jet had hit the rear end of the Euler body.

EXAMPLES

Shaped charge assemblies comprising the liners as shown in FIGS. 1*b*, 2, 3, 4 and 5 were tested at a stand off 205 mm. Rolled homogenous armour was used as target. Penetrations depths were recorded as presented in Table 1 below. The liners were all made of copper. Furthermore, assemblies comprising the liners shown in FIGS. 2-5 all had the same diameter of the liner at the discharge end (about 84 mm as calculated based on the explosive body), as well as the same longitudinal extension of the liner and casing (about 150 mm as calculated based on the explosive body). The shaped charge assembly comprising the liner shown in FIG. 1*b* was of a slightly smaller size.

It can be clearly seen from the results that the shaped charge assemblies comprising liners as shown in FIGS. 2 to 4 result in considerably greater penetration depths compared to a conventional shaped charge assembly comprising the liner as shown in FIG. 1*b*. Although the size of the shaped charge assembly comprising the liner shown in FIG. 1*b* was slightly smaller, said difference in size is not proportional to the increase in penetration depth obtained for the liners shown in FIGS. 2-4. Furthermore, it can be seen that the penetration depths of the shaped charge assemblies shown in FIGS. 2 to 4 are also considerably greater than the penetration depth of a shaped charge assembly shown in FIG. 5.

TABLE 1

| Liner type | Penetration depth |
|---|---|
| FIG. 1b-comparative | 545 mm |
| FIG. 2 | >>700 mm |
| FIG. 3 | >700 mm |
| FIG. 4 | 698 mm |
| FIG. 5-comparative | 596 mm |

The invention claimed is:

1. A shaped charge assembly comprising a casing, and a rotational symmetrical liner, the casing and liner is coaxially arranged around a longitudinal central axis, wherein the casing and the liner together defines a volume configured to contain an explosive, wherein the liner comprises:

a first longitudinal section having the shape of a truncated cone, is tulip-shaped, is trumpet-shaped, or is partial-hemisphere shaped, and comprising a base end and an opposing truncated end, the first longitudinal section is connected at its base end to the casing;

a second longitudinal section having the shape of a truncated cone and comprising a base end and an opposing truncated end, the truncated end of the second longitudinal section connected by means of an intermediate longitudinal section, to the truncated end of the first longitudinal section;

a third longitudinal section is directly connected to the base end of the second longitudinal section, the third longitudinal section having the shape of a cone, an ogival or a hemisphere;

wherein a tangent of a radially internal surface of the third longitudinal section and a tangent of a radially internal surface of the second longitudinal section at the connection between the third longitudinal section and the second longitudinal section forms an angle β of from 80° to 130°; and wherein, the intermediate longitudinal section consists of a first longitudinal portion and a second longitudinal portion, the first longitudinal portion is directly connected to the first longitudinal section and the second longitudinal portion is directly connected to the second longitudinal section, and wherein the first longitudinal portion is in the shape of a truncated cone having cone angle smaller than a cone angle of the second longitudinal section, wherein the third longitudinal section has a longitudinal extension of maximally 20% of a longitudinal extension of the liner.

2. The shaped charge assembly according to claim 1, wherein the first longitudinal section has a longitudinal extension of at least 50% of a longitudinal extension of the liner.

3. The shaped charge assembly according to claim 1, wherein the first longitudinal section has a longitudinal extension of at most 80% of a longitudinal extension of the liner.

4. The shaped charge assembly according to claim 1, wherein the inner diameter of the second longitudinal section at its truncated end is within the range of 20% to 40% of the inner diameter at the base end of the first longitudinal section.

5. The shaped charge assembly according to claim 4, wherein the inner diameter of the second longitudinal section at its truncated end is within the range of 20% to 35%, of the inner diameter at the base end of the first longitudinal section.

6. The shaped charge assembly according to claim 1, wherein the third longitudinal section has the shape of an ogival or a hemisphere having a radius ranging from 5% to 85% of the diameter of the first longitudinal section at its base end.

7. The shaped charge assembly according to claim 1, wherein the liner has a wall thickness of from 0.1 to 5 mm.

8. The shaped charge assembly according to claim 7, wherein the third longitudinal section has the shape of an ogival or a hemisphere having a radius ranging from 20% to 60%, of the diameter of the first longitudinal section at its base end.

9. The shaped charge assembly according to claim 1, wherein the liner is made of a metallic material having a density of from 2 to 25 g/cm3.

10. The shaped charge assembly according to claim 1, wherein a tangent of a radially internal surface of the first longitudinal portion of the intermediate longitudinal section and a tangent, midway of a radial extension of the second longitudinal portion, of a radially internal surface of the second longitudinal portion of the intermediate longitudinal section forms an angle γ which is smaller than the angle β.

11. A shaped charge assembly comprising a casing, and a rotational symmetrical liner, the casing and liner being coaxially arranged around a longitudinal central axis, wherein the casing and the liner together defines a volume configured to contain an explosive, wherein the liner comprises:

a first longitudinal section having the shape of a truncated cone, being tulip-shaped, being trumpet-shaped, or being partial-hemisphere shaped, and comprising a base end and an opposing truncated end, the first longitudinal section being connected at its base end to the casing;

a second longitudinal section having the shape of a truncated cone and comprising a base end and an opposing truncated end, the truncated end of the second longitudinal section being directly connected, or connected by means of an intermediate longitudinal section, to the truncated end of the first longitudinal section;

a third longitudinal section being directly connected to the base end of the second longitudinal section, the third longitudinal section having the shape of an ogival or a hemisphere;

wherein a tangent of a radially internal surface of the third longitudinal section and a tangent of a radially internal surface of the second longitudinal section at the connection between the third longitudinal section and the second longitudinal section forms an angle ß of from 80° to 130°;

and wherein, if present, the intermediate longitudinal section consists of a first longitudinal portion and a second longitudinal portion, the first longitudinal portion being directly connected to the first longitudinal section and the second longitudinal portion being directly connected to the second longitudinal section, and wherein the first longitudinal portion is in the shape of a truncated cone having cone angle smaller than a cone angle of the second longitudinal section, wherein the third longitudinal section has a longitudinal extension of maximally 20% of the longitudinal extension of the liner, wherein the third longitudinal section has the shape of an ogival or a hemisphere having a radius ranging from 5% to 85%, of the diameter of the first longitudinal section at its base end.

* * * * *